US005829914A

United States Patent [19]

Wells

[11] Patent Number: 5,829,914

[45] Date of Patent: Nov. 3, 1998

[54] ASPHALT REPAIR METHOD UTILIZING CHILLING

[76] Inventor: Raymond Wells, P.O. Box 257, Mayo, Fla. 32066

[21] Appl. No.: 719,645

[22] Filed: Sep. 25, 1996

[51] Int. Cl.[6] ..... E01C 23/00

[52] U.S. Cl. ..... 404/73; 404/82; 404/70; 404/79

[58] Field of Search ..... 404/72, 73, 75, 404/82, 70, 71, 134; 427/136, 138, 374.1, 374.5, 374.6

[56] References Cited

U.S. PATENT DOCUMENTS

| | | | |
|---|---|---|---|
| 4,104,206 | 8/1978 | Hachisu et al. | 260/2.3 |
| 4,507,013 | 3/1985 | Martinak | 404/75 |
| 4,678,363 | 7/1987 | Sterner | 404/75 |
| 4,699,542 | 10/1987 | Shoesmith . | |
| 4,744,693 | 5/1988 | Smith | 404/77 |
| 4,833,892 | 5/1989 | Wassibauer et al. | 62/78 |
| 4,948,431 | 8/1990 | Strickland et al. | 106/273.1 |
| 5,111,627 | 5/1992 | Brown | 52/126.5 |
| 5,263,790 | 11/1993 | Bickley et al. | 404/107 |
| 5,364,205 | 11/1994 | Lemelson | 404/72 |
| 5,387,050 | 2/1995 | Hovis et al. . | |
| 5,405,212 | 4/1995 | Swisher, Jr. et al. . | |
| 5,405,213 | 4/1995 | O'Conner | 404/77 |
| 5,464,303 | 11/1995 | Wells | 404/75 |
| 5,511,899 | 4/1996 | Pavelek, II . | |

FOREIGN PATENT DOCUMENTS

| | | | |
|---|---|---|---|
| 1625913 | 2/1991 | U.S.S.R. | 404/108 |

*Primary Examiner*—James Lisehora
*Attorney, Agent, or Firm*—Terrance L. Siemens

[57] ABSTRACT

A method of repairing asphalt or concrete surfaces such as roads and parking lots which have developed pot holes therein. The hole is cleaned of loose debris, lined with a water barrier sheet, provided with a reinforcing mesh, and filled with hot asphalt mix. The asphalt mix is compacted by a roller which has been chilled by exposure to a cryogenic substance, such as liquid nitrogen. Alternatively, the cryogenic substance directly contacts the asphalt mix. Preferably, the reinforcing mesh is further reinforced by flattened rods woven through the mesh or alternatively, laid thereon, with the rods oriented at angles of approximately forty-five degrees to linear structural members of the mesh. The water barrier, reinforcing mesh, and reinforcing rods are preferably formed from recycled plastic materials.

3 Claims, 3 Drawing Sheets

ASPHALT REPAIR METHOD UTILIZING CHILLING

BACKGROUND OF THE INVENTION

1. Field of the Invention

The present invention relates to a method for repairing asphalt roads, parking lots, driveways, and other structures which may utilize a stratum of asphalt, bituminous, concrete, or similar material. More particularly, the invention comprises a method of forming a patch or filling of a hole in such a road, lot, driveway, or structure. The method includes a step of accelerating curing or hardening of hot asphalt mix employed to fill the hole by application of a cryogenic material.

2. Description of the Prior Art

Asphalt surfaces, such as roads, parking lots, alleys, driveways, and the like are subject to deterioration over time. This may occur as a result of freezing and expansion cycles, ground heaving, overweight vehicles, and other causes. Limited areas of the surface may break or exhibit holes, which then must be repaired. Typically, pavement is repaired by filling holes with asphalt or concrete alone. While this method is relatively quickly performed, the resulting patches lack durability. The original problem may recur within one or two years.

The prior art has suggested modifications to methods of constructing or patching asphalt roads by merely laying down and rolling a stratum of asphalt. For example, the asphalt stratum may be reinforced. In U.S. Pat. No. 4,699,542, issued to Roy Shoesmith on Oct. 13, 1987, there is described a method of reinforcing roadway by placing a filament fiberglass mesh in the asphalt. However, unlike the present invention, there is no chilling of the asphalt. Nor does Shoesmith lay down a water barrier nor interweave partially rigid rods through the mesh, both steps being features of the present invention.

U.S. Pat. No. 5,405,212, issued to George W. Swisher on Apr., 11, 1995, describes apparatus for paving with concrete, there being provision for inserting a dowel rod into uncured concrete. But because Swisher addresses concrete construction and not asphalt, chilling is inappropriate in Swisher's method. In further contrast to the present invention, Swisher fails to teach use of a water barrier and interweaving reinforcing rods into a mesh.

Pavelek, II describes a road construction incorporating an internal stratum of asphalt roofing shingle material which, among other properties, serves as a liquid barrier. However, Pavelek, II fails to teach chilling of asphalt and placing of a reinforcing mesh in asphalt.

My prior U.S. Pat. No. 5,464,303, issued on Nov. 7, 1995, describes mesh reinforcement of asphalt repairs and reinforcing rods, but lacks improvements disclosed herein. These improvements include forming flat surfaces on the reinforcing rods, and utilizing chilling of the asphalt fill material.

None of the above inventions and patents, taken either singly or in combination, is seen to describe the instant invention as claimed.

SUMMARY OF THE INVENTION

The present invention greatly improves upon current patching and repairing methods applied to asphalt and concrete surfaces of roads and the like. These surfaces will hereinafter collectively be termed road surfaces for brevity. The patch is protected by a water barrier placed first in the hole or area being repaired. A water barrier is preferably a flexible sheet of material having a nominal thickness and preventing passage therethrough of water in either liquid or gaseous form. Next, a mesh having rods laid on the mesh or interwoven therethrough is placed over the water barrier. Then, the hole is filled with hot asphalt mix, which is then compacted by tamping or rolling.

At or towards the end of the compacting step, the asphalt is subjected to extreme chilling. Preferably, the temperature of the chilled medium contacting the asphalt is in a cryogenic range of temperatures, that being below any temperature naturally encountered on Earth. However, benefits from chilling will still be present even if the temperature of the chilling medium is above the cryogenic range. Therefore, methods similar to the preferred novel repair method may be employed without resorting to handling cryogenic materials.

An illustration of a preferred chilling medium is liquid nitrogen. Liquid nitrogen is among the least expensive of commercially available cryogenic materials, and also among the most user friendly. It can therefore be handled and employed with minimal risk of damage to equipment and injury to personnel. Of course, some care is necessary in handling any cryogenic material.

The liquid nitrogen, or cold vapors resulting from evaporation of liquid nitrogen, may be directly discharged onto freshly compacted asphalt. Alternatively, the roller of a power rolling machine may be chilled with liquid or vaporous nitrogen. It would even be possible to inject a cryogenic substance into the asphalt.

A preferred material for fabricating the water barrier, the reinforcing mesh, and the reinforcing rods woven through the mesh is recycled plastic. This is both an efficient use of an otherwise waste material, and also a convenient, cooperative constituent material for the components of the repair. Melting and softening temperatures of recycled plastic are above temperatures conventionally attained by asphalt mix, i.e., up to 325° Fahrenheit. However, if desired, the water barrier may be fabricated from commercially available cross linked or cross laminated virgin plastic sheet material, preferably in the range of 3 to 7 mils in thickness.

At these temperatures, the water barrier will become quite flexible, but is unlikely to rupture. Flexibility is desirable in repairs since the water barrier will exhibit a greater tendency to conform to the exposed or upper surface of the untreated hole than would otherwise occur.

The water barrier promotes deterrence of permeation of water through the repaired road surface. This feature alone will improve longevity of the repair and of the road surface.

Chilling hastens and improves internal bonding within the repair patch and of the repair patch to the original road surface. In particular, deformation of the new repair by traffic employing the road surface shortly after completion of the repair is minimized. This also improves longevity of the repair.

Placement of reinforcing members in the asphalt serves several purposes. One is that loads imposed on the repair or patch are distributed and absorbed throughout greater area of asphalt. This reduces peak loading of local areas, and slows deformation of the asphalt surface. Mass movement or shifting of material of the road responsive to forward and lateral loads imposed by traffic is prevented. The overall coherence of the patch is improved, and sections are less likely to break away over time.

In an improvement over the rods shown in my previous patent, the rods are formed with a flat portion formed in the external circumferential surface. This reduces tendency to roll when the rods are merely laid on the mesh rather than interwoven therethrough.

Also, structural reinforcing members may be exploited to contain sensors for sensing passing traffic. This enables installation of sensors at the same time as performing repairs. Also, supporting members for the sensors are provided, so that a network of sensors is more quickly and expediently located in an asphalt surface.

Thus, it will be seen that improved repair to asphalt may be performed quickly and conveniently. The improved method of repair employs generally conventional equipment and procedures for distribution of hot asphalt, and hence entails no highly unusual steps requiring retraining of personnel or expensive purchases of equipment. Yet the repair will enjoy benefits of greatly improved longevity and strength.

It would also be feasible to construct new roads or other asphalt surfaces by employing the principles disclosed herein. The invention may be regarded as repairing existing asphalt surfaces and also constructing new asphalt surfaces not associated with pre-existing asphalt surfaces. Therefore, it will be understood that references to repair will apply equally to new construction.

Accordingly, it is a principal object of the invention to provide a method of repairing an asphalt surface which improves longevity of the repair over that of conventional repair methods.

It is another object of the invention to provide immediate internal bonding of asphalt material upon compacting this material when repairing an asphalt surface.

It is a further object of the invention to provide a water barrier promoting deterrence of water permeation through the repaired asphalt surface.

Still another object of the invention is to provide reinforcement members in the improved or repaired asphalt surface.

An additional object of the invention is to make use of recycled plastic scrap material.

It is again an object of the invention to provide a quickly performed and economical method of repairing asphalt surfaces.

Yet another object of the invention is to enable convenient placement of traffic sensors in a roadway.

A still further object of the invention is to prevent reinforcing rods from rolling when laid on reinforcing mesh.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
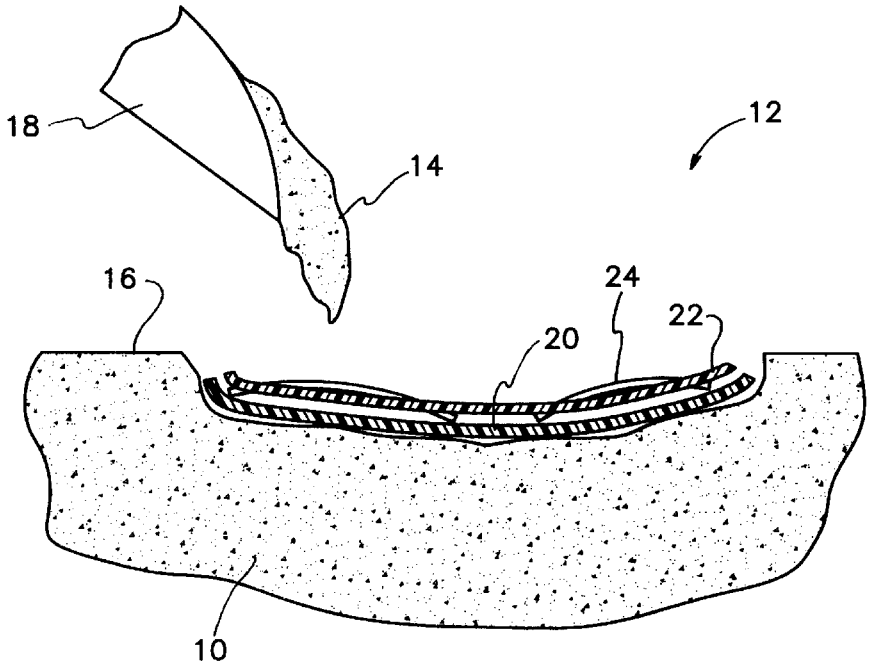
FIG. 1 is an environmental, cross sectional, partly exploded view of the invention.

Turning now to FIG. 1 of the drawings, the novel method of repairing an asphalt surface 10 having a hole 12 is illustrated by showing hole 12 in a condition prepared for hot asphalt fill material 14 to be discharged into hole 12. Hole 12 is merely representative of different forms of voids formed in asphalt surface 10, which voids are to be filled in order to restore a generally flat upper surface 16 of asphalt surface 10. For brevity, all such voids will be referred to as hole 12.

Hole 12 is suitably prepared for repair. Preparation may include removing loose debris, accumulated water, and other materials which will interfere with bonding of fill material 14 or which may impair desirable properties of asphalt surface 10 in any way. This step is completely conventional. Asphalt fill material 14 is also of conventional constituents, and may be poured in conventional manner. Conventional asphalt distributing equipment is represented by chute 18.

Figure 2:
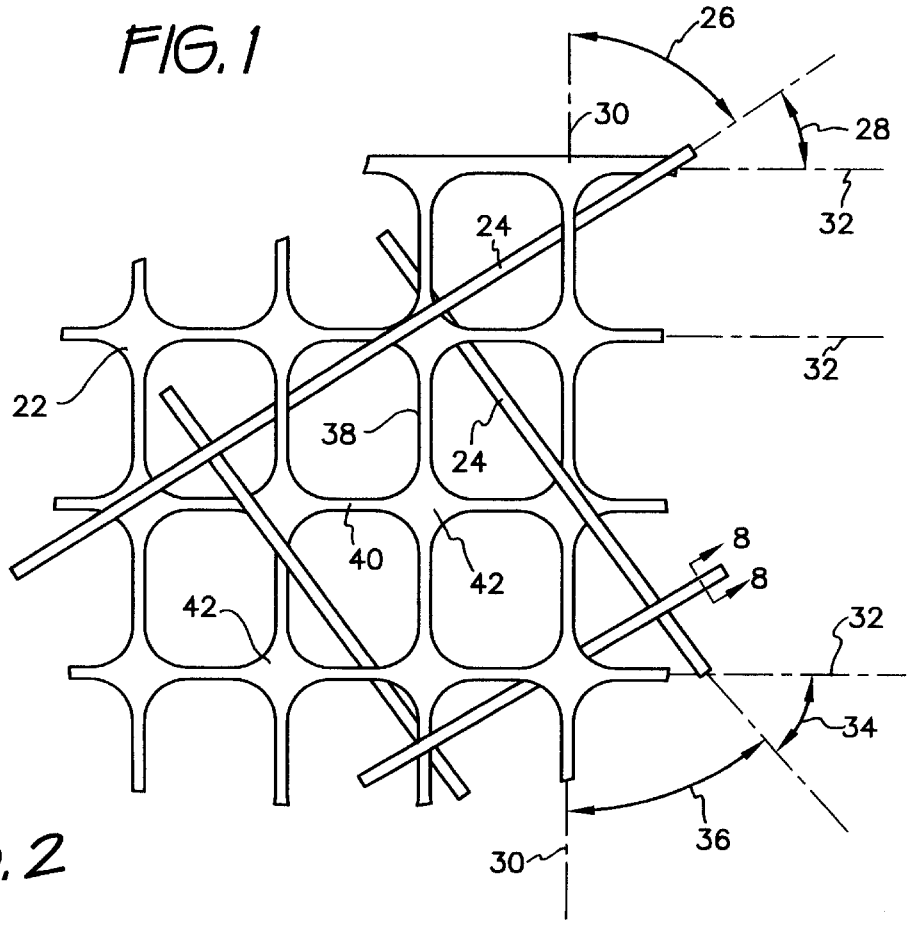
FIG. 2 is a top plan detail view of reinforcing mesh and rods shown at the center of FIG. 1.

A first novel step in the repair method is lining hole 12 with a water or vapor barrier 20. The second novel step is placing a reinforcing mesh 22 in the hole. FIG. 2 shows a preferred reinforcing mesh 22 and rods 24 which are interwoven through mesh 22. It will be seen in FIG. 2 that rods 24 are oriented at oblique angles 26, 28 to the linear dimensions 30, 32 of mesh 22. Preferably, rods 24 are disposed to intersect with other rods 24 which are also oriented at oblique angles 34, 36 to dimensions 30, 32 of mesh 22.

Mesh 22 is preferably includes linear structural members 38 and 40 disposed perpendicularly to one another, being fused or joined at intersections 42. Preferred construction of mesh 22 and of rods 24 is more fully discussed in my prior U.S. Pat. No. 5,464,303, issued on Nov. 7, 1995, Ser. No. 08/175,933, filed Dec. 30, 1993, which is incorporated herein by reference.

Figures 3, 3A, 5, 6, 7:
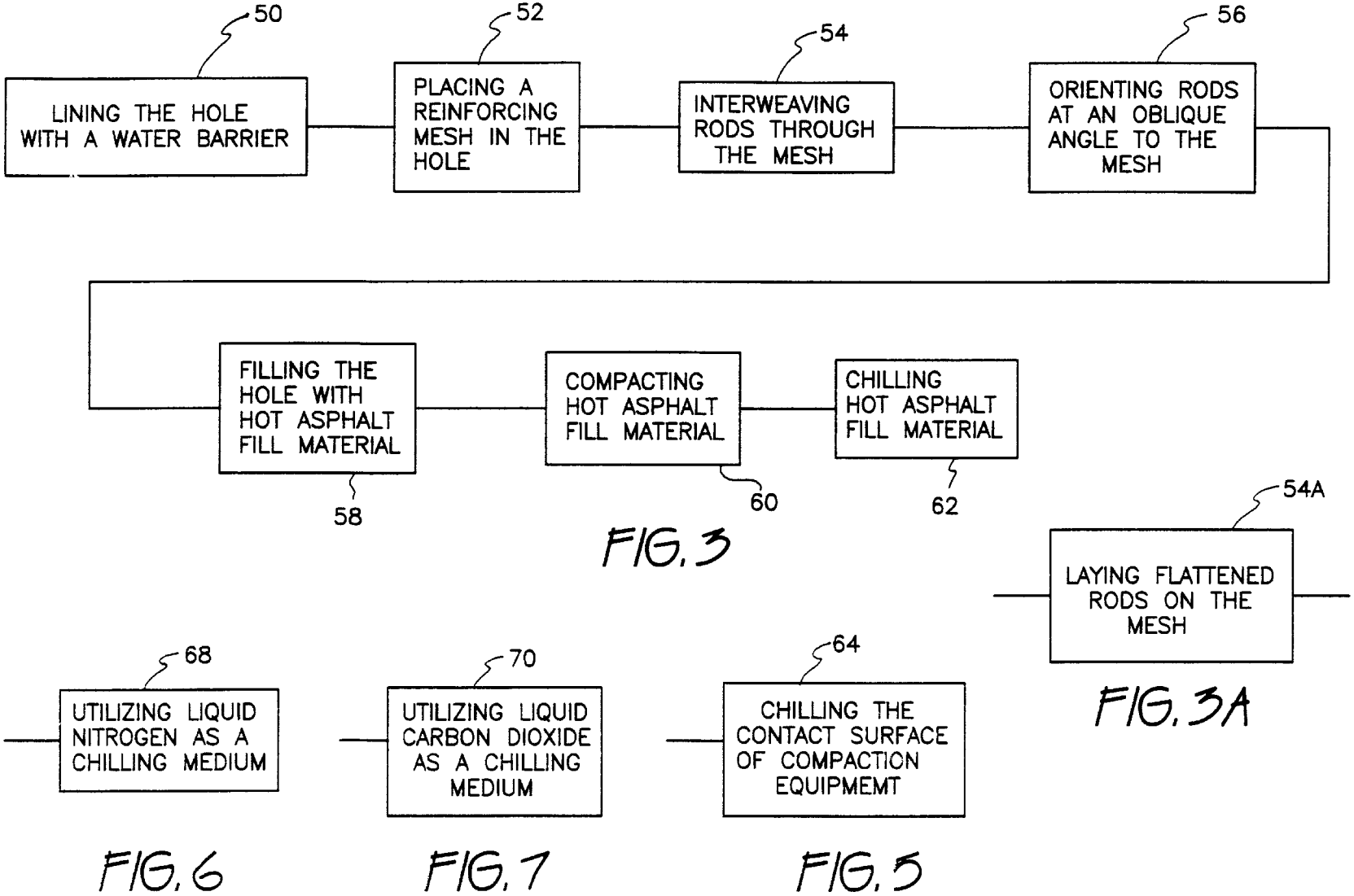
FIG. 3 is a block diagram of steps of a method of practicing the invention.
FIG. 3A is a partial block diagram illustrating an alternative step of the method of FIG. 3.
FIGS. 5, 6, and 7 are block diagrams each illustrating an optional step which may be practiced with the method of FIG. 3.

Returning now to discussion of the novel method, and with reference to FIG. 3 as well as FIGS. 1 and 2, the first novel step of lining hole 12 with liner 20 is designated 50. The second step of placing mesh 22 in hole 12 is designated 52. A third step 54 is interweaving rods 24 through mesh 22. Step 56 is orienting rods 24 at an oblique angle to linear structural members 38 and 40 of mesh 22.

Figure 8:
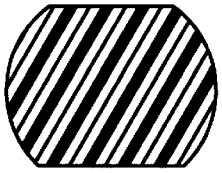
FIG. 8 is an end elevational, cross sectional view of a rod, taken at line 8—8 of FIG. 2.

Rods 24 are of any cross sectional configuration other than round or circular, so that they will not roll when place on or in mesh 22. Additional advantages of non-round or non-circular configuration are that rods 24 are easier to bend when interweaving through mesh 22, and are easier to grasp when interweaving. A preferred embodiment of a flattened rod 22 is shown in FIG. 8.

To reduce time of installation, rods 24 are optionally laid on mesh 22 rather than interwoven therethrough. The term "on" will be understood to signify that each rod 24 is entirely above, although possibly in contact with, mesh 22. This is in contrast to interwoven therethrough, wherein sections of a rod 24 periodically pass over a member of mesh 22.

Incorporation of rods 24 provides reinforcement which is particularly useful in cases wherein the repair is subjected to tangential forces from braking vehicles. Bus stops are frequently the subject of repairs, and also are highly susceptible to tangential forces arising from busses as they brake to a stop. Rods 22 reduce tendency of the repair from eventually being broken away from effective bonding with surface 10.

The method summarized in FIG. 3 may be modified by omitting step 54, and substituting step 54A illustrated in FIG. 3A.

Hole 12 is then filled with hot asphalt fill material 14 in the next step 58. A subsequent step 60 is compacting hot asphalt fill material 14. Steps 58 and 60 may be performed with conventional materials and equipment.

A further novel step 62 is chilling hot asphalt fill material 14. Chilling asphalt material 14 will be understood to signify active steps to reduce temperature of asphalt at working temperatures. Mere neglect of laid asphalt at working temperatures, typically in the range of 275°–325° Fahrenheit, will result naturally in heat transfer to the environment by radiation, convection, and conduction. This is a purely passive process as related to human effort. Therefore, for purposes of defining the novel process, the step of chilling is differentiated from passive heat loss by actual steps to reduce temperature of laid asphalt by subjecting the laid asphalt to temperatures below those encountered under normal working conditions.

Normal working conditions may include discharging of water onto rollers of compaction equipment. Cooling obtained by contact of water with asphalt is inadequate for the purposes of this invention. Cooling will be understood to encompass provision of a chilling medium having temperatures below freezing. This is best accomplished when the temperature difference between the chilling medium and the freshly laid asphalt is maximal. This condition is produced by employing cryogenic substances, with or without phase change of the cryogenic substance. However, since economics has great impact upon asphalt repair, if an inexpensive or convenient source of a chilled medium is at hand, then it may be preferable to employ a chilling medium above cryogenic temperatures, as discussed prior.

Figure 4:
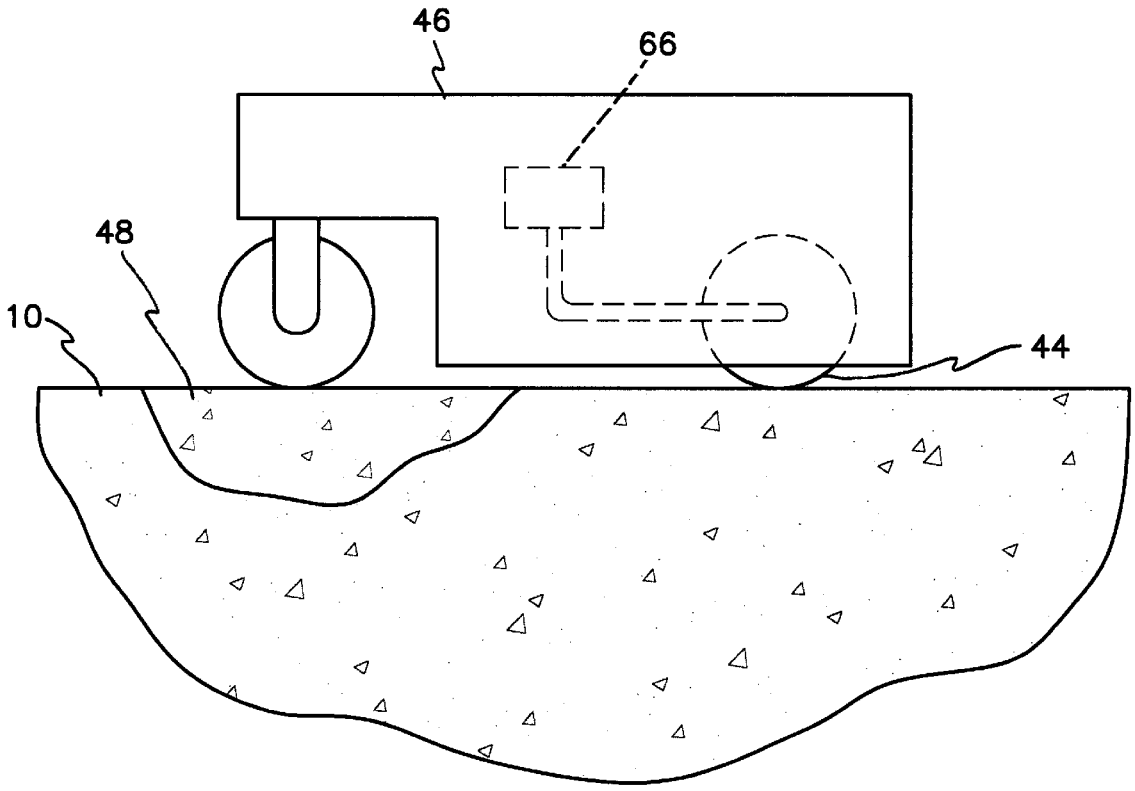
FIG. 4 is an environmental, side elevational, partly cross sectional view illustrating an optional method of chilling asphalt.

Step 62 of chilling asphalt fill material 14 may be accomplished in several ways. Obviously, a chilled medium may be poured, sprayed, or otherwise discharged onto laid asphalt (this process is not shown). A preferred method is illustrated in FIG. 4. It is preferred that a cryogenic substance be introduced into heat exchange relation to a surface 44 of compaction equipment, such as powered roller 46, contacting the new patch 48. This method is summarized as step 64 in FIG. 5. Step 64 is a modification or variation of step 62 of FIG. 3.

Preferred chilling media include liquid nitrogen and liquid carbon dioxide. These materials may be stored within roller 46, as shown by tank 66 in FIG. 4. Steps of employing liquid nitrogen and liquid carbon dioxide are modifications or variations of step 62 of FIG. 3, and are shown as step 68 of FIG. 6 and step 70 of FIG. 7, respectively.

It will be appreciated that provision of water barrier 20, mesh 22, and rods 24 are independent of the step 62 of chilling newly laid asphalt fill material 14. Also, provision of water barrier 20 is independent of provision of structural reinforcing members, such as mesh 22 and rods 24.

The essence of the present invention is to chill newly laid asphalt, as described prior. Steps of the essential invention include the step 58 of filling hole 12 with hot asphalt fill material 14, step 60 of compacting hot asphalt fill material 14, and step 62 of chilling asphalt fill material 14 after filling hole 12.

Not absolutely essential, but regarded as significantly improving longevity of the repair in environments subject to presence of water in any form, is step 50, lining hole 12 with water barrier 20. Also not essential, but regarded as effective in distributing loads over greater area, is reinforcing new patch 48 (see FIG. 4). Additional steps of the essential method of steps 58, 60, and 62, or of the improved method incorporating step 50, are step 52 of placing reinforcing mesh 22 in hole 12, step 54 of interweaving rods 24 through mesh 22, and step 56 of orienting rods 22 at oblique angles 26, 28, 34, or 36 to linear members 38, 40 of mesh 22. Of course, steps 52, 54, and 56 may be utilized without utilizing step 52.

In variations of step 62, or in subsequent steps, any of the above methods may be practiced by including a further step of subjecting asphalt fill material 14 to heat exchange relationship with a cryogenic temperature. This may be accomplished, illustratively but not exclusively, by step 68 of FIG. 6, utilizing liquid nitrogen as a chilling medium, or by step 70 of FIG. 7, utilizing liquid carbon dioxide as the chilling medium.

Obviously, it is the temperature and not the actual phase of the chilling medium that is crucial to the invention. When employed for cryogenic purposes, nitrogen may be in the liquid state, gaseous or vapor state, or both when transferring heat from the contact surface 44 of compaction equipment 46 (see FIG. 4). The same holds true for other cryogenic substances or mixtures of several cryogenic substances. In the case of liquid carbon dioxide and other materials subject to sublimation, it is possible that solid and gaseous states only be encountered.

Regardless of temperature of the chilling medium, it is regarded as most practical to subject material 14 to reduced temperature by step 64 of FIG. 5, chilling contact surface 44 (see FIG. 4) of compaction equipment 46. Of course, chilling media (not shown) may be introduced to patch 48 in other ways, such as by injection thereinto.

It is to be understood that the present invention is not limited to the embodiments described above, but encompasses any and all embodiments within the scope of the following claims.

I claim:

1. A method of repairing a road surface having a hole comprising the steps of:

placing a reinforcing mesh in the hole and interweaving flattened reinforcing rods through said reinforcing mesh;

orienting said flattened reinforcing rods at an oblique angle to structural members of said reinforcing mesh;

filling the hole with hot asphalt fill material;

chilling the contact surface of a compaction apparatus; and compacting said hot asphalt fill material; whereby said chilled contact surface of said compaction apparatus serves to absorb heat from said asphalt fill material to improve the bonding and durability of said compacted asphalt fill material.

2. The method of repairing a road surface having a hole according to claim 2, further including the step of placing a vapor barrier in the hole prior to the step of placing said reinforcing mesh in the hole.

3. A method of repairing a road surface having a hole comprising the steps of:

placing a reinforcing mesh in the hole and interweaving flattened reinforcing rods through said reinforcing mesh;

orienting said flattened reinforcing rods at an oblique angle to structural members of said reinforcing mesh;

filling the hole with hot asphalt fill material;

compacting and simultaneously chilling said hot asphalt fill material; whereby said chilled asphalt fill material has improved bonding characteristics and durability.

* * * * *